US006343132B1

(12) United States Patent
Fukuhara et al.

(10) Patent No.: US 6,343,132 B1
(45) Date of Patent: Jan. 29, 2002

(54) LOUDSPEAKER

(75) Inventors: Suemei Fukuhara; Isao Kuramitsu, both of Hirakata; Tatsuya Omori, Uji; Toshiyuki Mizutani, Mino, all of (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/030,793

(22) Filed: Feb. 26, 1998

(30) Foreign Application Priority Data

Feb. 28, 1997 (JP) ..... 9-045595

(51) Int. Cl.[7] ..... H04R 1/02; H04R 1/20

(52) U.S. Cl. ..... 381/339; 381/160; 381/306; 181/185; 181/191

(58) Field of Search ..... 381/306, 307, 381/27, 337, 338, 339, 160, 352; 181/152, 191, 155, 185

(56) References Cited

U.S. PATENT DOCUMENTS

| | | | | | |
|---|---|---|---|---|---|
| 5,004,067 | A | * | 4/1991 | Patronis | 181/188 |
| 5,173,942 | A | * | 12/1992 | Hirose | 381/89 |
| 5,274,709 | A | * | 12/1993 | Koizumi | 381/306 |
| 5,402,502 | A | * | 3/1995 | Boothroyd et al. | 381/160 |
| 5,446,792 | A | * | 8/1995 | Sango | 381/160 |
| 5,604,337 | A | * | 2/1997 | Sugimoto et al. | 181/152 |
| 5,943,430 | A | * | 8/1999 | Saitoh | 381/160 |
| 6,122,386 | A | * | 9/2000 | Wiley | 381/160 |

FOREIGN PATENT DOCUMENTS

| | | |
|---|---|---|
| JP | 4-270600 | 9/1992 |
| JP | 8-47097 | 2/1996 |
| JP | 8-130794 | 5/1996 |

OTHER PUBLICATIONS

"Experiments on the Interaction Between a Sound Image and a Video Image", Setsu. Komiyama, Katsumi Nakabayashi and Seiya Nikaido, Society for Acoustic Research, 1981.

* cited by examiner

*Primary Examiner*—Xu Mei
*Assistant Examiner*—Brian Pendleton
(74) *Attorney, Agent, or Firm*—Wenderoth, Lind & Ponack, L.L.P.

(57) ABSTRACT

The present invention provides a loudspeaker capable of matching a sound image and a picture image on a screen of an image reproducer with each other in simple construction and a simple method of installation. The loudspeaker is located above the image reproducer in the vicinity thereof and so constructed as to reproduce a center channel signal in a multichannel sound signal for a movie or the like as a principal object, which comprises a main speaker unit, particular band preventing means for suppressing the level of a particular band in a band of not less than approximately 4 kHz of the main speaker unit, a sub-speaker unit, particular band passing means connected to the sub-speaker unit for passing only the particular band, and a dispersing device located on a front surface of the sub-speaker unit and so constructed that a reproduced sound radiated from the sub-speaker unit is mainly composed of a diffused sound.

11 Claims, 10 Drawing Sheets

LOUDSPEAKER

BACKGROUND OF THE INVENTION

1. Field of the Invention

The present invention relates to a loudspeaker combined with a picture image reproducer is so constructed as to reproduce a center channel signal in a multichannel sound signal for a movie or the like as a principal object, and more particularly, to realization of reproduction in which a sound image and a picture image coincide with each other utilizing characteristics in acoustic psychology.

2. Related Art Statement

In recent years, impressive and powerful movies or the like have been increasingly enjoyed, even in homes upon being reproduced by combining a large screen television (TV) and a sound reproducer for reproducing a multichannel sound signal, for example, a Dolby prologic.

As shown in FIG. 16, a conventional multichannel sound reproducer combined with such a picture image reproducer comprises a loudspeaker 2L for reproducing a left channel signal and a loudspeaker 2R for reproducing a right channel signal which are located on the left and right sides of a TV 5 placed ahead of a viewer 6, a loudspeaker 11 located on the TV 5 for reproducing a center channel signal, and two loudspeakers 4R and 4L located at the sides of the viewer 6 for respectively reproducing surround signals. And these apparatuses are arranged in a room confined by four walls WF, WB, WR, and WL, as typically shown in FIG. 16.

In the multichannel sound signal reproducer, the loudspeakers 2L and 2R respectively reproduce left and right channel sound signals, and the loudspeaker 11 mainly reproduces dialogues spoken by characters on a TV screen, for example. The normal location of the lines is greatly improved by providing the loudspeaker. Further, the loudspeaker 4L and 4R reproduces a surround channel signal representing reverberations and a reflected sound. A sound field at which the viewer 6 feels as if he or she was present is formed by sounds radiated from the loudspeakers.

In the above-mentioned conventional construction, however, the center channel signal is reproduced from the loudspeaker 11 located on the TV 5, so that a sound image is formed around a position indicated by B, as shown in FIG. 17. On the other hand, a picture image is reproduced by the TV 5 under the loudspeaker 11. Therefore, the position of the sound image and the position of the picture image are separated from each other, thereby giving an uncomfortable feeling to the viewer 6.

As a method of solving such points, it is considered that two loudspeakers 12 for respectively reproducing center channel signals are located on both the right and left sides of a TV 5 in the vicinity thereof, as shown in FIG. 18. In such construction, the center channel signals are synthesized upon being respectively radiated from the loudspeakers 12A and 12B located on the right and left sides of the TV 5, so that a sound image is formed in the center (C) between the two loudspeakers 12A and 12B. Consequently, it is possible to perform reproduction in which the positions of the sound image and a picture image coincide with each other.

In the construction shown in FIG. 18, however, when the viewer 6 views a screen of the TV 5 in a position shifted leftward, as indicated by 6*a,* for example, the sound image on a center channel is also shifted to a position indicated by Ca, thereby giving an uncomfortable feeling to the viewer 6. Further, the loudspeakers 2L and 2R for respectively reproducing the left and right channel sound signals must be respectively located outside the loudspeakers 12, so that large spaces for installation are required on the right and left sides of the TV 5. If there are a lot of loudspeakers on the right and left sides of the screen, the picture image may be visually prevented from being viewed.

In order to avoid such points, JP-A-4-270600 discloses that two loudspeakers 12A and 12B for respectively reproducing center channel signals are arranged above and below a TV 5, as shown in FIG. 19. If the loudspeakers 12A and 12B are thus arranged, a sound image is formed in a position substantially in front of the TV 5 indicated by D, thereby making it possible to perform reproduction in which the positions of the sound image and a picture image coincide with each other. In this construction, however, large spaces for installation are required both above and below the TV 5.

As means for solving the above-mentioned problems, the inventors and others of the present invention have proposed a loudspeaker for reproducing a center channel signal utilizing characteristics in acoustic psychology in JP-A-8-47097 and JP-A-8-130794. In the publications, it is made clear that a particular band in a frequency band of not less than approximately 4 kHz, and particularly a band in a range of approximately one octave centered around 6.3 kHz is important in recognizing the positions above and below a sound source as the acoustic characteristics of human beings. The contents proposed in the publications are applications of the characteristics in acoustic psychology and "Effect of visual priority" described in "Experiments on the interaction between a sound image and a video image" published by Komiyama, Nakabayashi, Nikaido, et al. (Material in Society for Acoustic Research, 1981), for example.

In JP-A-8-47097, each of the loudspeakers located above and below a picture image reproducer in the vicinity thereof comprises as main components sound pressure attenuating means for suppressing sound pressure in the vicinity of 6.3 kHz, and a main speaker connected thereto, and further comprises a sub-speaker located, facing in a direction different from the main speaker, and band passing means connected thereto for supplying a frequency band in the vicinity of 6.3 kHz. That is, the loudspeaker is so constructed that a sound having a frequency of 6.3 kHz is removed from the main speaker for reproducing a direct sound, and its band is reproduced as a diffused sound utilizing reflection from a rear wall or the like by the sub-speaker. As a result, the position of a sound source of a center channel signal is not easily recognized. A viewer feels as if a sound image was drawn to a TV screen due to the effect of visual priority and coincided with a picture image.

In this construction, however, when the distance from the rear wall is large or there is no wall, the level of a reproduced sound from the sub-speaker becomes low, so that the level in a high frequency region is liable to be insufficient as the entire reproduced sound. In order to improve this point, it is considered that the sub-speaker is provided on a ceiling surface. As apparent from recent experiments, however, if a sound having a frequency in the vicinity of 6.3 kHz is reproduced toward the ceiling of a room, the viewer feels as if the position of the sound source was not only clarified but also moved further upward.

On the other hand, in JP-A-8-130794, a sub-speaker for reproducing a sound having a frequency in the vicinity of 6.3 kHz and a main speaker for reproducing a sound having a frequency other than the frequency in the vicinity of 6.3 kHz are constructed as separate cabinets, the smaller sub-speaker being located above a picture image reproducer such that a sound radiating axis of its speaker unit is directed backward, and the main speaker being located below the image reproducer. In such construction, it is possible to perform reproduction in which a picture image and a sound image coincide with each other utilizing characteristics in acoustic psychology, as in JP-A-8-47097. However, the construction requires that loudspeakers are located in two positions, so that wiring becomes complicated. Further, the distance from a rear wall is important in order to keep the balance in a frequency band of a reproduced sound, as in JP-A-8-47097.

SUMMARY OF THE INVENTION

The present invention has been made in view of the above-mentioned conventional problem, and has for its object to provide, for reproducing a center channel signal, a loudspeaker capable of easily matching a picture image and a sound image with each other without considering the distance from a rear wall and taking a large space for installation, and capable of minimizing visual interference.

In order to solve the above-mentioned problems, according to a first aspect of the present invention, a loudspeaker apparatus for converting a first audio signal to audible sound comprises:

a band suppressor for suppressing a first predetermined band in the first audio signal to produce a second audio signal;

a first speaker unit connected to the band suppressor for converting the second audio signal to a first sound wherein the first predetermined band is suppressed;

a band filter for passing a second predetermined band in the first audio signal to produce a third audio signal;

a second speaker unit connected to the band filter for converting the third audio signal to a second sound wherein the second predetermined band is audible; and a dispersing unit located over the second speaker unit for diffusing the second sound therefrom.

As is apparent from the above, according to the first aspect, since the level in the vicinity of the first predetermined band of the second is suppressed, the viewer does not easily recognize the position of a sound source in terms of acoustic characteristics. On the other hand, a sound having the second predetermined band is radiated sideward, and is reflected from the walls or the like, to reach the viewer. Consequently, the viewer recognizes the second sound as an indirect sound, so that the position of the sound source is also difficult to recognize.

According to a second aspect, in the first aspect, a loudspeaker apparatus is located above an image reproducer in the vicinity thereof for exclusively reproducing a center channel signal in a multi-channel sound signal for a movie or the like as a principal object.

As is apparent from the above, according to the second aspect, a sound image is drawn to a screen due to the effect of visual priority, so that the viewer feels as if the sound image and a picture image coincide with each other.

According to a third aspect, in the loudspeaker apparatus of the first aspect, the band suppressing unit is comprised of a dip circuit; and the band filter is comprised of a band-pass circuit.

According to a fourth aspect, in the loudspeaker apparatus of the first aspect, the first speaker unit and the second speaker unit are arranged such that acoustic radiating axes thereof are parallel to each other.

According to a fifth aspect, in the loudspeaker apparatus of the fourth aspect, the first speaker unit and the second speaker unit are located on one plane.

As is apparent from the above, according to the fifth aspect, since the first and second speaker units can be mounted on the same plane, it becomes easy to process the cabinet and assemble the entire loudspeaker.

According to a sixth aspect, in the loudspeaker apparatus of the first aspect, the first speaker unit and the second speaker unit are arranged such that acoustic radiating axes thereof are perpendicular to each other.

According to a seventh aspect, in the loudspeaker apparatus of the sixth aspect, the first speaker unit is located on a first plane; and the second speaker unit is located on a second plane perpendicular to the first plane.

According to an eighth aspect, in the loudspeaker apparatus of the first aspect, the first and second predetermined band are the same.

According to a ninth aspect, in the loudspeaker apparatus of the eight aspect, the first and second predetermined band are in a range of approximately a half to two octaves and are not less than 4 kHz.

According to a tenth aspect, in the loudspeaker apparatus of the eight aspect the first and second predetermined bands are in a predetermined range centered around 6.3 kHz.

According to an eleventh aspect, in the loudspeaker apparatus of the first aspect, the dispersing unit comprises a sound reflecting member spreading along with a plane perpendicular to the acoustic radiating axis of the second speaker unit from the side of the acoustic radiating axis to reflect the second sound at least one time therein, the sound reflecting member being comprised of a first top plate and first and second side walls extending by a predetermined length longer than a half of sound wave length corresponding to the second predetermined band to part from each other with a first predetermined angle.

According to a twelfth aspect, in the loudspeaker apparatus of the eleventh aspect, the dispersing unit further comprises a sound diffusing unit having a second top wall and third and fourth side walls connected to the first top wall and first and second side wall, respectively, on the distal end thereof with respect to the acoustic radiating axis for diffusing the third sound in various directions, the third and fourth side walls being parted from each other a second predetermined angle.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of a loudspeaker according to the present invention will be described in detail with reference to the drawings. With reference to FIGS. 1, 2, 3, 4, 5, 6, 7, 8, 9, 10, 11, and 12, a loudspeaker apparatus according to the first embodiment of the present invention will described first. Then after, the loudspeaker apparatus according to the second embodiment will be described with reference to FIGS. 13, 14, and 15.

(First Embodiment)

Figure 1:
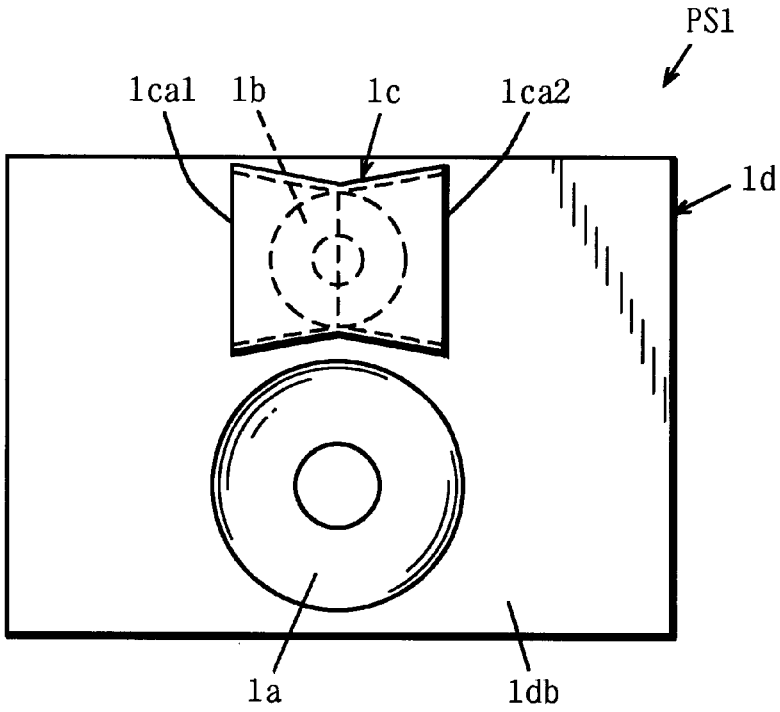
FIG. 1 is a front view showing a loudspeaker apparatus according to a first embodiment of the present invention.

Referring to FIG. 1, a front view of a loudspeaker apparatus PS1 is shown. 1*a* denotes a main speaker unit, and 1*b* is a sub-speaker unit. Both the speaker units are mounted on a front baffle plate 1*db* of a speaker cabinet 1*d*. Further, a dispersing device 1*c* is mounted on a front surface of the sub-speaker 1*b* by a mounting device. The dispersing device 1*c* spreads from the center toward the openings 1*ca*1 and 1*ca*2 at the both ends. The sub-speaker unit 1*b* and the dispersing device 1*c* will be described in details with reference to FIGS. 3 to 9.

Figure 2:
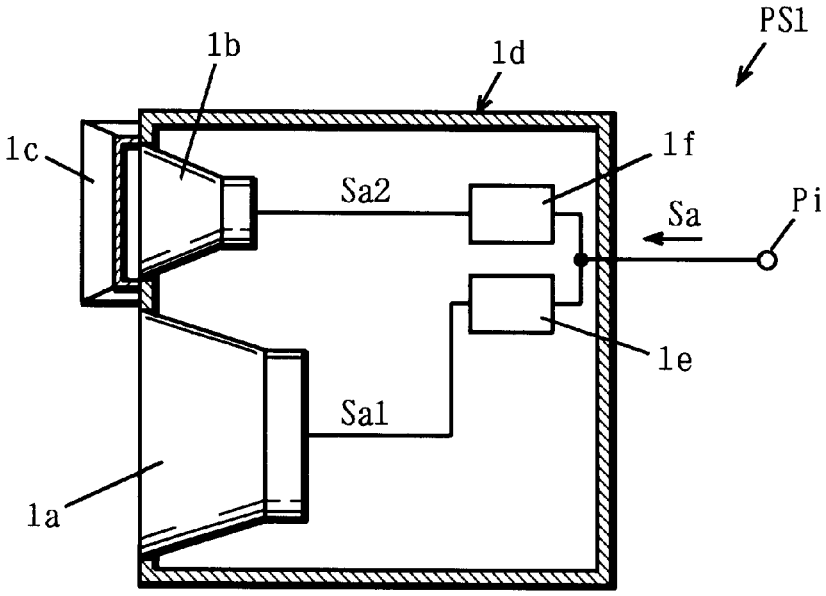
FIG. 2 is a cross-sectional view showing the loudspeaker apparatus of FIG. 1.

Referring to FIG. 2, a cross-sectional view of the loudspeaker apparatus PS1 is shown. Reference symbol Pi is an input port provided for receiving an audio signal Sa which is used for a center channel from an external audio signal source (not shown). Reference numeral 1*e* denotes a dip circuit for suppressing a signal having a frequency F in the vicinity of 6.3 kHz, and 1*f* denotes a band-pass circuit for passing only the signal having the frequency F in the vicinity of 6.3 kHz. The dip circuit 1*e* is connected between the input terminal Pi and the main-speaker unit 1*a* for producing a band suppressed audio signal Sa1 by suppressing the frequency F in the center channel audio signal Sa, and supplying thereof to the main-speaker unit 1*a*. The band-pass circuit 1*f* is connected between the input terminal Pi and the sub-speaker unit 1*b* for producing a band passed audio signal Sa2 to pass by allowing the frequency F of the center channel audio signal Sa, and supplying the band passed audio signal to the sub-speaker unit 1*b*.

Figure 10:
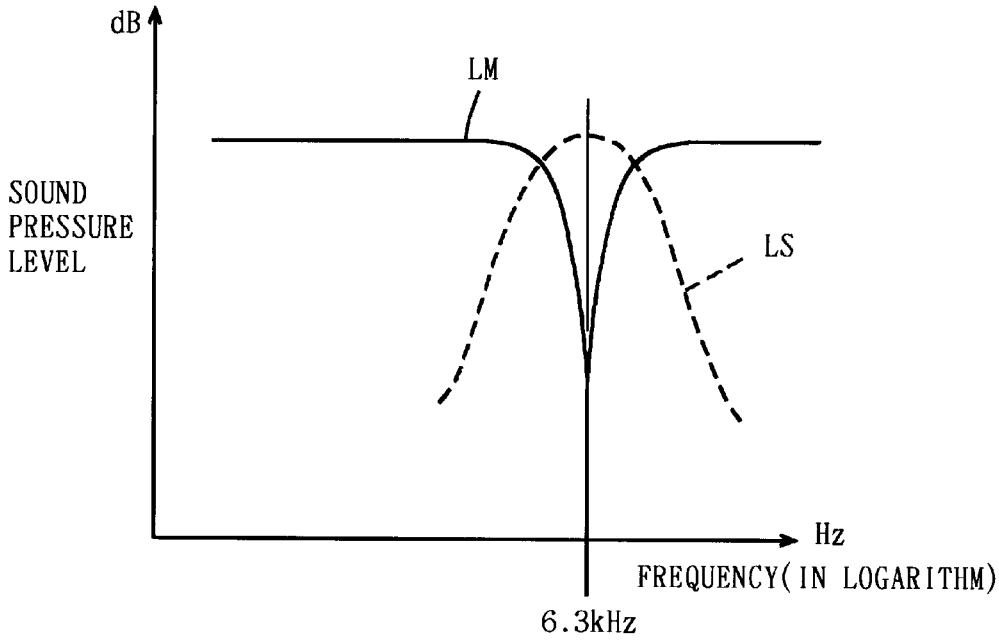
FIG. 10 is a graph for the assistance of explaining the frequency response characteristics of the sound reproduced by the first and second speaker units of the loudspeaker apparatus according to the first embodiment of the present invention.

The main speaker unit 1*a* and the sub-speaker unit 1*b* are respectively so adjusted as to exhibit sound pressure frequency characteristics which will be shown in FIG. 10 by the circuits. Specifically, the dip circuit 1*e* can be constructed by any suitable means that can function as a band suppressor for preventing a particular band from passing. Similarly, the band-pass circuit can be constructed by any suitable means that can function as band filter for allowing a particular band passing therefrom.

Figure 3:
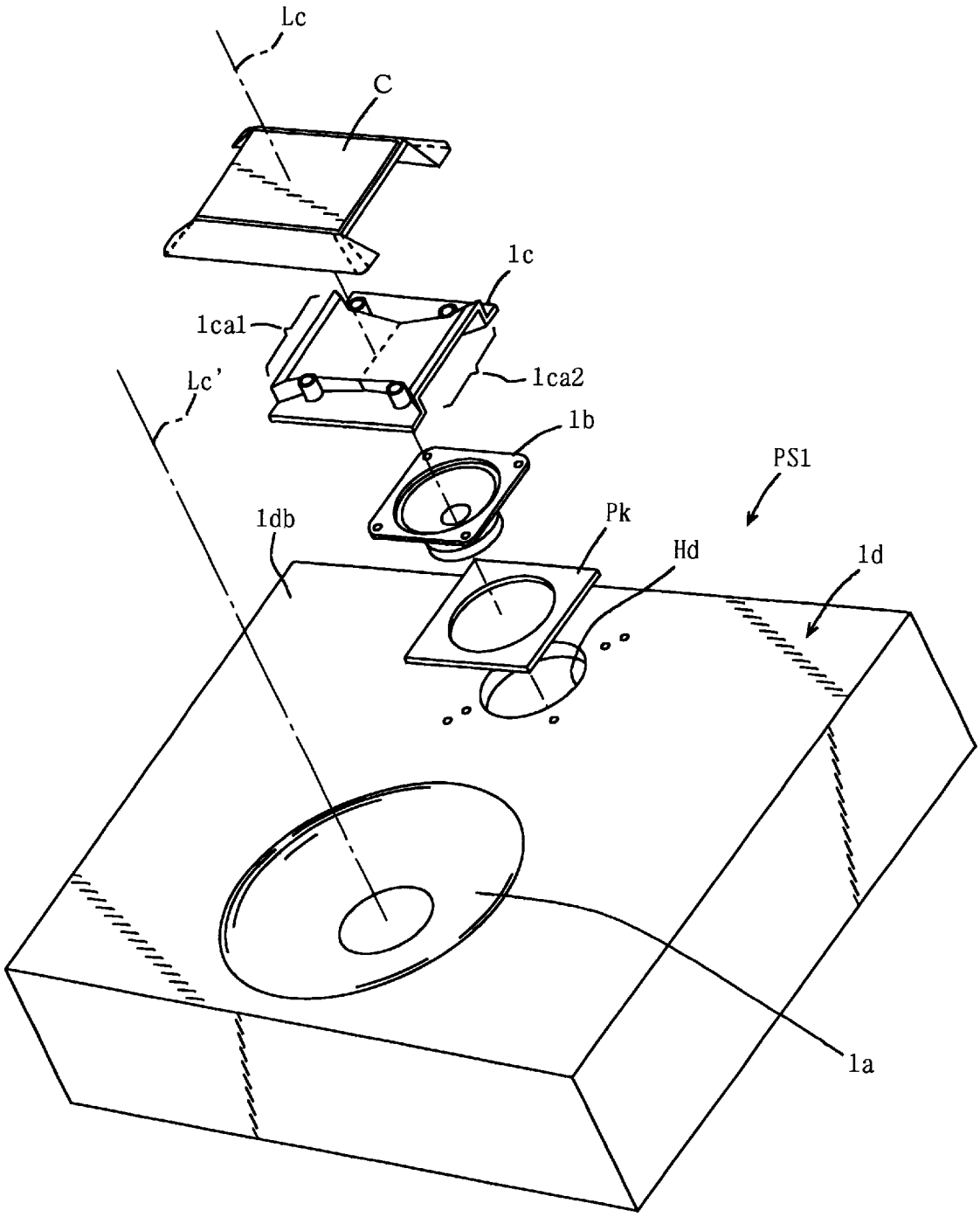
FIG. 3 is a developed view schematically showing the sub-speaker unit to be installed in the loudspeaker apparatus of FIG. 1.

Referring to FIG. 3, the sub-speaker unit 1*b* installed in the baffle plate 1*db* of the speaker cabinet 1*d* is shown. Along with a center axis of a through hole Hd formed in the baffle plate 1*db*, a packing PK, a body of the sub-speaker unit 1*b*, the dispersing device 1*c*, and a cover C are mounted in a shown order. In this example, the center axis Lc is identical to a sound radiating axis of the speaker unit 1*b*. Similarly, in FIG. 3, the sub-speaker unit 1*b* and the main-speaker unit 1*a* are positioned such that the sound radiating axis Lc of speaker Lb are arranged to be parallel to a sound radiating axis Lc' of the main-speaker 1*a*. These two speaker units 1*a* and 1*b* can be located in substantially the same plane or discrete planes, respectively.

Figure 4:
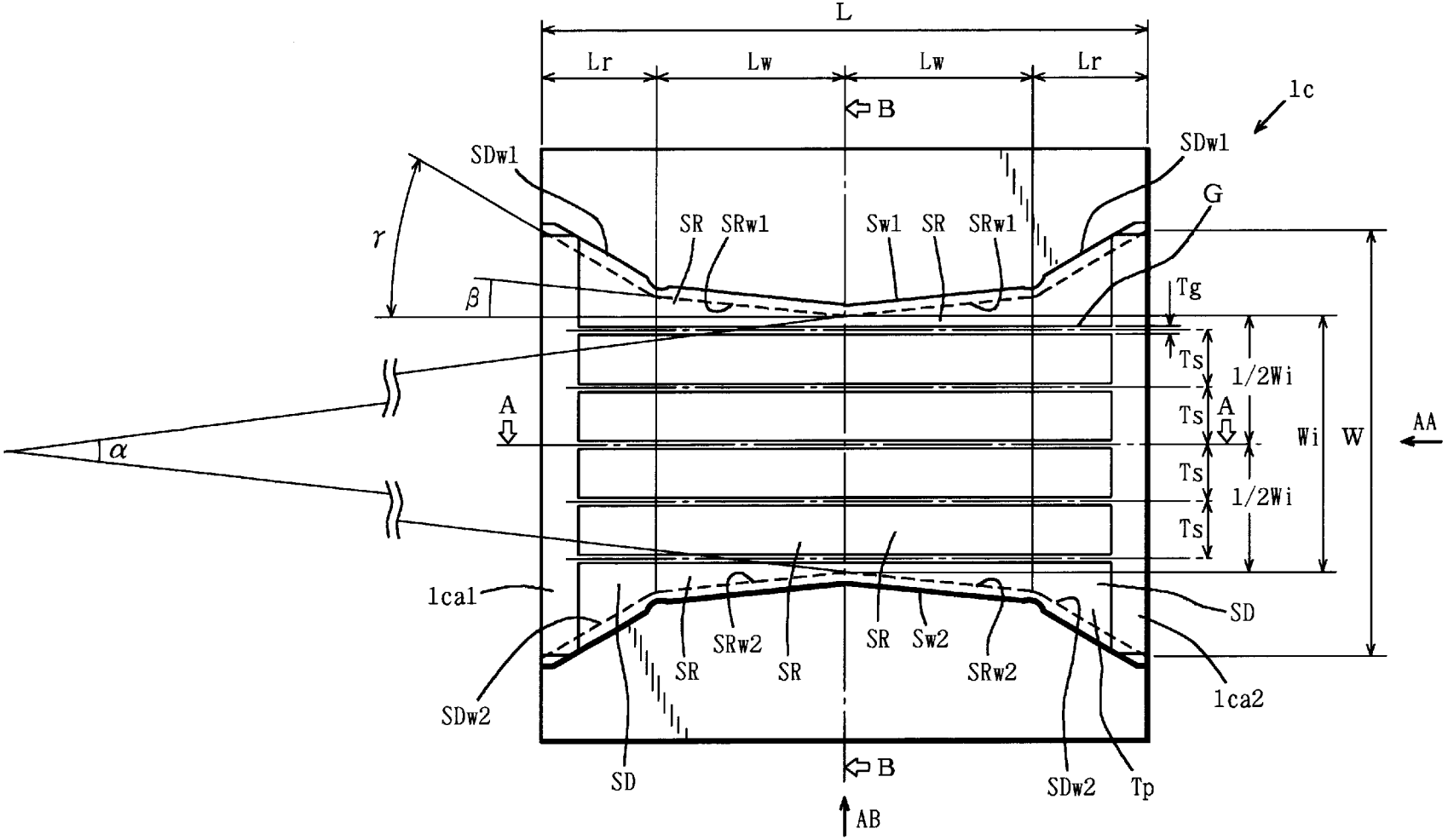
FIG. 4 is a plan view showing the dispersing device of FIG. 3.

With reference to FIGS. 4 to 9, a construction of dispersing device 1*c* is described in detail here below. Referring to FIG. 4, a plan view of the dispersing device 1*c* is shown. In this example, the dispersing device 1*c* is constructed by a top plate member Tp opposing to a plane defined by a first center line A—A and a second center line B—B. Two side wall members SW1 and SW2 are provided to the side edge portions of the plate member Tp on a symmetrical position with respect to the center line A—A in a pose substantially perpendicular to the plate Tp.

The distance between the side wall members SW1 and SW2 is the minimum Wi (Wi/2 from the center line A—A to each of side wall members SW1 and SW2), and becomes larger. Each of side wall members SW1 and SW2 has reflecting side walls SR extending the center line position thereof by a length Lw in a direction A—A with an inclination angle $\beta(0°<\beta<45°)$ with respect the center line A—A. Consequently each of side wall members SW1 and SW2 is formed in generally a V-shape by two reflecting side walls SRW1 and SRW2, respectively. From each of the distal ends of reflecting side walls SRW1 and SRW2, dispersing side wall member SDW1 (SDW2) extends with another inclination angle $\gamma$ $(0°<\gamma<90°,\gamma>\beta)$. As a result, the opposing side walls SW1 (SRW1) and SW2 (SRW2) are parted from each other by an apart angle $\alpha$ $(0°<\alpha=2\beta<90°)$. These angles $\alpha$,$\beta$, and $\gamma$ can be determined suitably in accordance with the circumstances where the loudspeaker PS is actually used in consideration of the frequency of the center channel sound.

The reflecting side walls SRW1 and SRW2 opposed to each other with respect to the center line B—B is sealed by the top wall member Tp to form a sound reflector SR for reflecting the sound radiated from the sub-speaker unit 1*b*. Furthermore, the dispersing side wall members SDW1 and SDW2 are also sealed by the top wall member Tp to form a sound diffuser SD for diffusing the sound reflected by the reflector SR. The distal ends of dispersing side walls SDW1 and SDW2 are left as opened by the width W as openings 1*ca*1 and 1*ca*2.

The length LW can be expressed by the following equations of $$\lambda = C/F \quad (1)$$

and $$Lw \geqq \lambda/2 \quad (2),$$

wherein λ is wave length of aimed sound, C is a velocity of aimed sound, and F" is a frequency of aimed sound to be reflected.

According to this embodiment, since F is set to 6.3 kHz for example, therefore λ is approximately 5.4 cm (at 20° C.) under equation (1). About 3 cm is desirable for Lw. Generally, the frequency F is set in a range of a half to two octaves, and is not less than 4 kHz.

In consideration of the mechanical strength, a reinforcing structure comprised of plural ribs G having width Tg extending in parallel to the center line A—A at an interval of Ts. On the outside of the reflection member SR and the side wall members SW1 and SW2, a sheet plate is provided for the convenience of installation.

Figure 5:
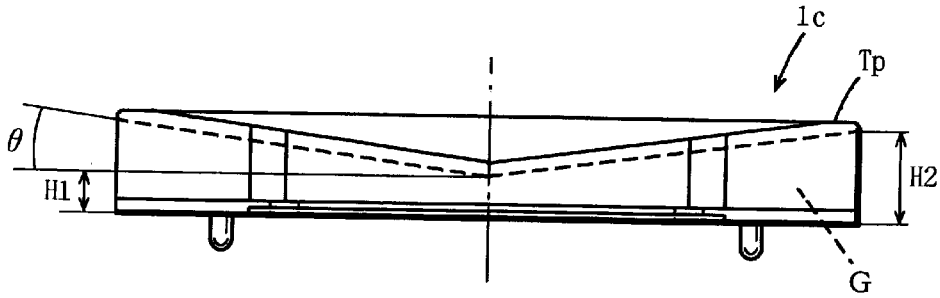
FIG. 5 is a view of the dispersing device of FIG. 4 looking in the direction indicated by the arrow see AB.
Figure 6:
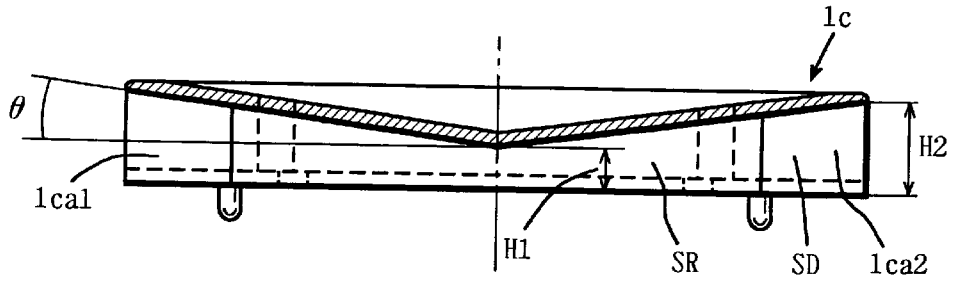
FIG. 6 is a cross-sectional view showing the dispersing device taken along with a line A—A in FIG. 4.

In FIGS. 5 and 6, a view looking in the direction of the AB arrow and a cross-sectional view taken along with a line A—A in FIG. 4 are shown, respectively. As typically shown in these figures, the height of the bottom of plate member Tp is the minimum height H1 at the position along the center line B—B, and linearly rises up toward both openings 1*ca*1 and 1*ca*2 with an elevation angle θ (0°<θ<45°) and reaches the Maximum height H2. The bottom height of the ridges Ts between grooves G is H2 over the whole area of the reflector SR and diffuser SD.

Figure 7:
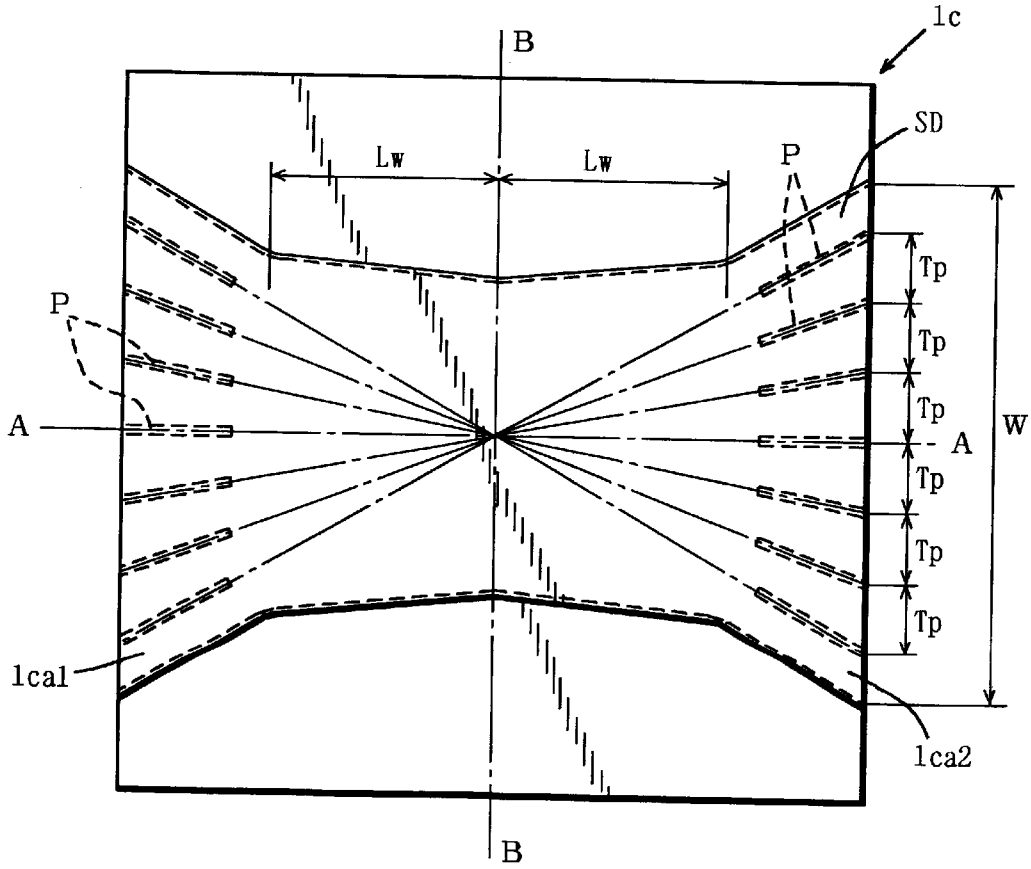
FIG. 7 is a plane view showing the dispersing device looking from the bottom side in FIG. 3.

Referring to FIG. 7, a bottom side view of dispersing device 1*c* of FIG. 4 is shown. Plural partitions P are provided on the bottom surface of diffuser SD along with lines each radiated from the center of device 1*c*, or favorably the intersection of lines A—A and B—B, for diffusing the sound more efficiently.

Figure 8:
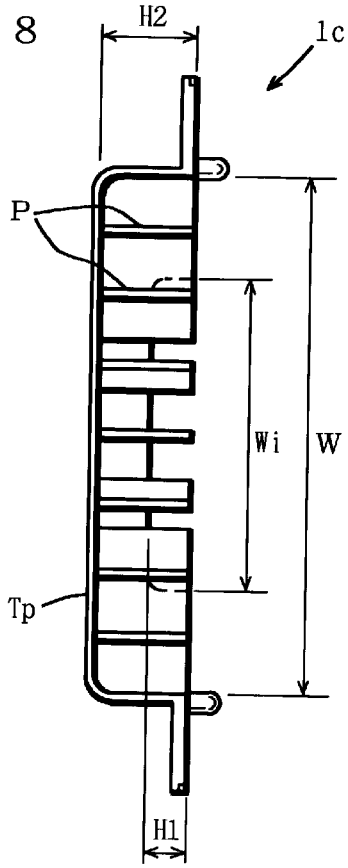
FIG. 8 is a view of the dispersing device of FIG. 4 looking in the direction indicated by the arrow AA.
Figure 9:
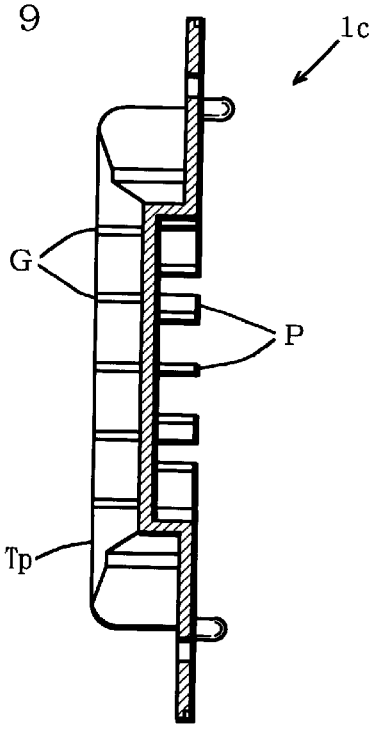
FIG. 9 is a cross sectional view showing the dispersing device taken along with a line B—B in FIG. 4.

In FIGS. 8 and 9, a view looking in the direction of the AA arrow and a cross-sectional view taken along with a line B—B in FIG. 4 are shown, respectively. Partitions P are typically shown on the side of opening 1*ca*2 in FIG. 8. Also, partitions P and ribs G are shown in FIG. 9.

Referring to FIG. 10, frequency response characteristics of the speaker apparatus PS1 main-speaker unit 1*a* reproducing the sound signal Sa1 and sub-speaker unit 1*b* reproducing the sound signal Sa2 are shown. The solid line LM and dot line LS indicate the characteristics of main-speaker unit 1*a* and sub-speaker unit 1*b*, respectively. The main speaker unit 1*a* and the sub-speaker unit 1*b* are mounted in vertical arrangement in the present embodiment in order to prevent the performance of the main speaker unit from being degraded by a cavity of the dispersing device 1*c*.

Figure 11:
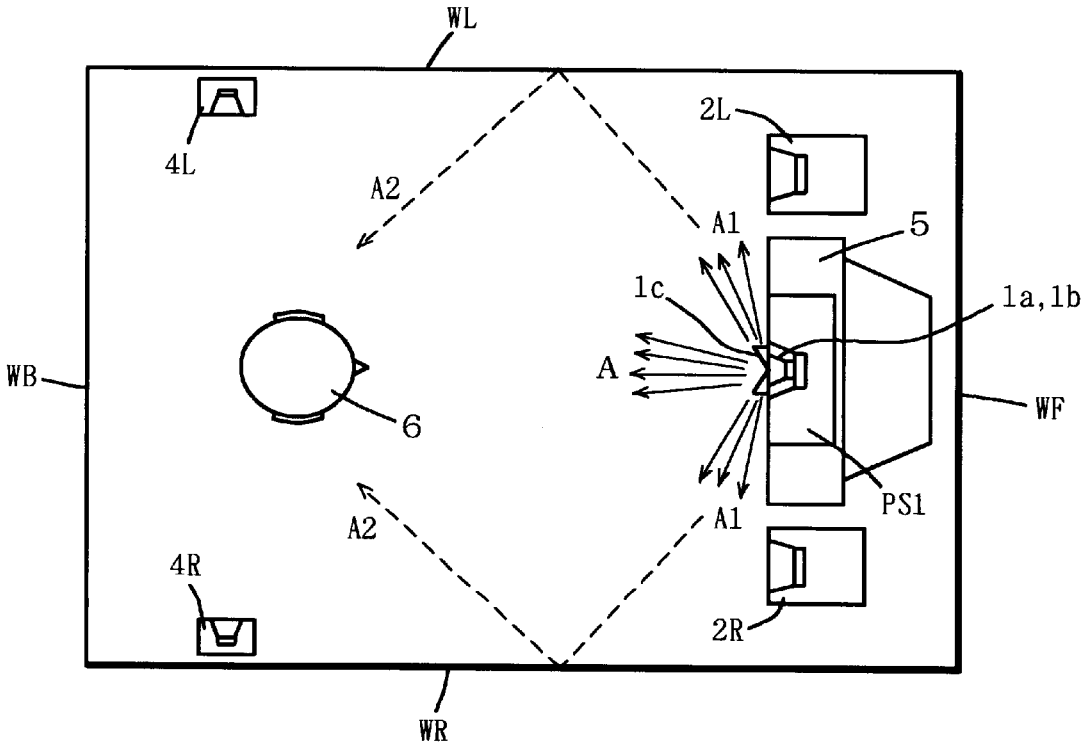
FIG. 11 is a graph for the assistance of explaining an operation of the loudspeaker apparatus, according to the first embodiment of the present invention, in a state where the loudspeaker is used for a center channel of a multichannel sound reproducer.
Figure 16:
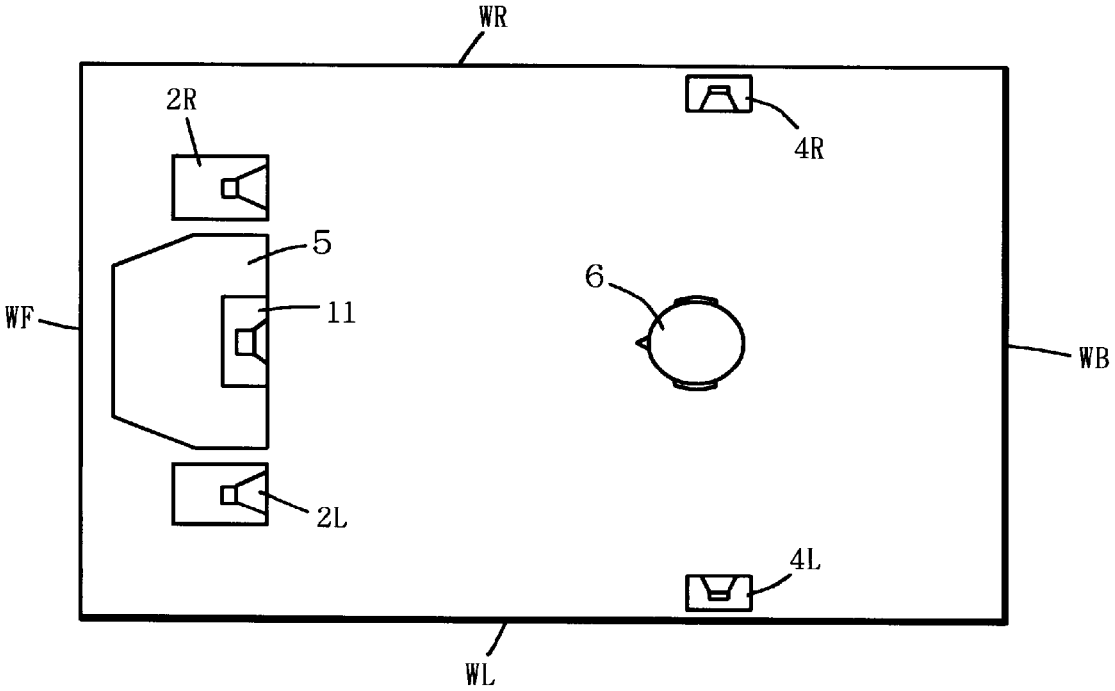
FIG. 16 PRIOR ART
FIG. 16 is a graph in the assistance of explaining an operation of a conventional loudspeaker apparatus in a state where the loudspeaker is used for a center channel of a multichannel sound reproducer.
Figure 17:
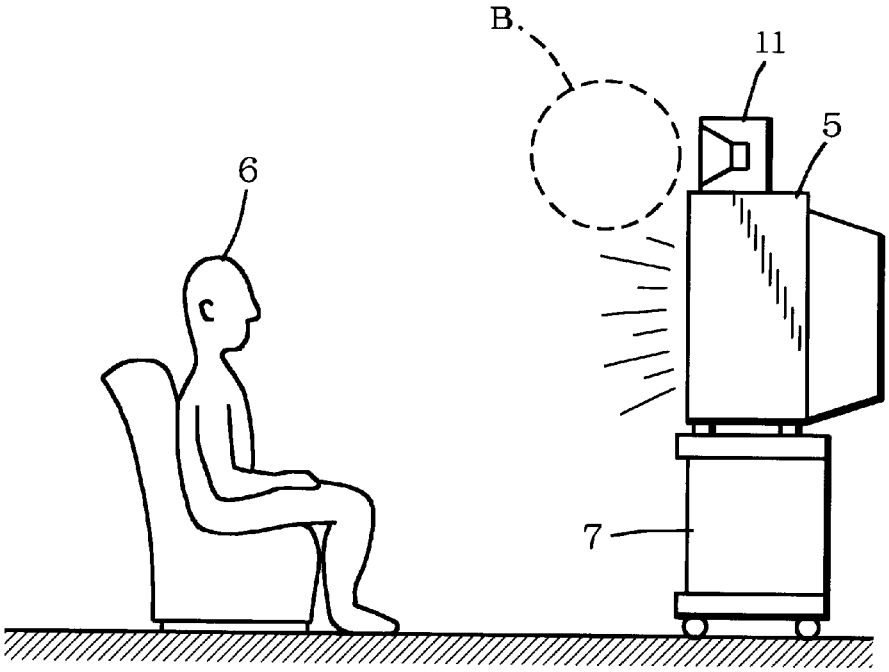
FIG. 17 PRIOR ART
FIG. 17 is a graph in the assistance of explaining the localization of a sound image in conventional center channel reproduction.
Figure 18:
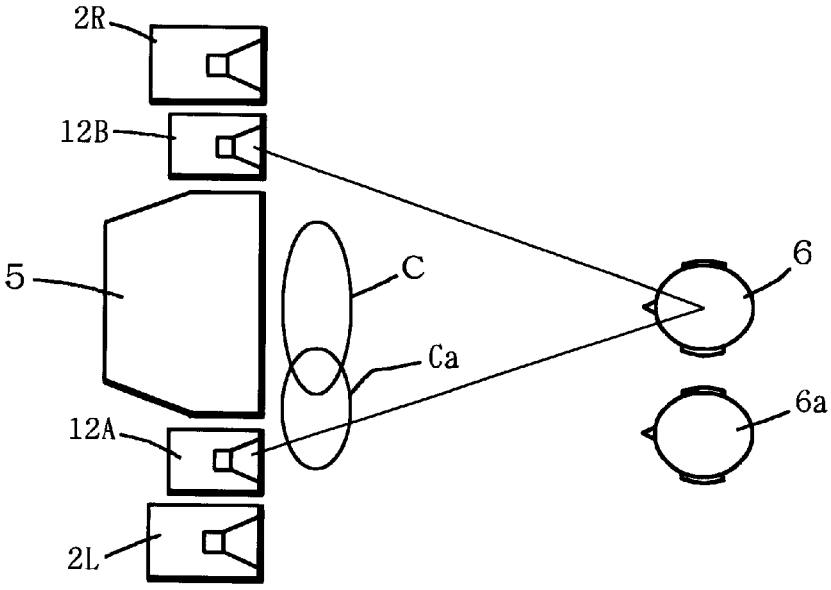
FIG. 18 PRIOR ART
FIG. 18 is a graph in the assistance of explaining the positioning of conventional loudspeaker apparatus and the localization of sound image.
Figure 19:
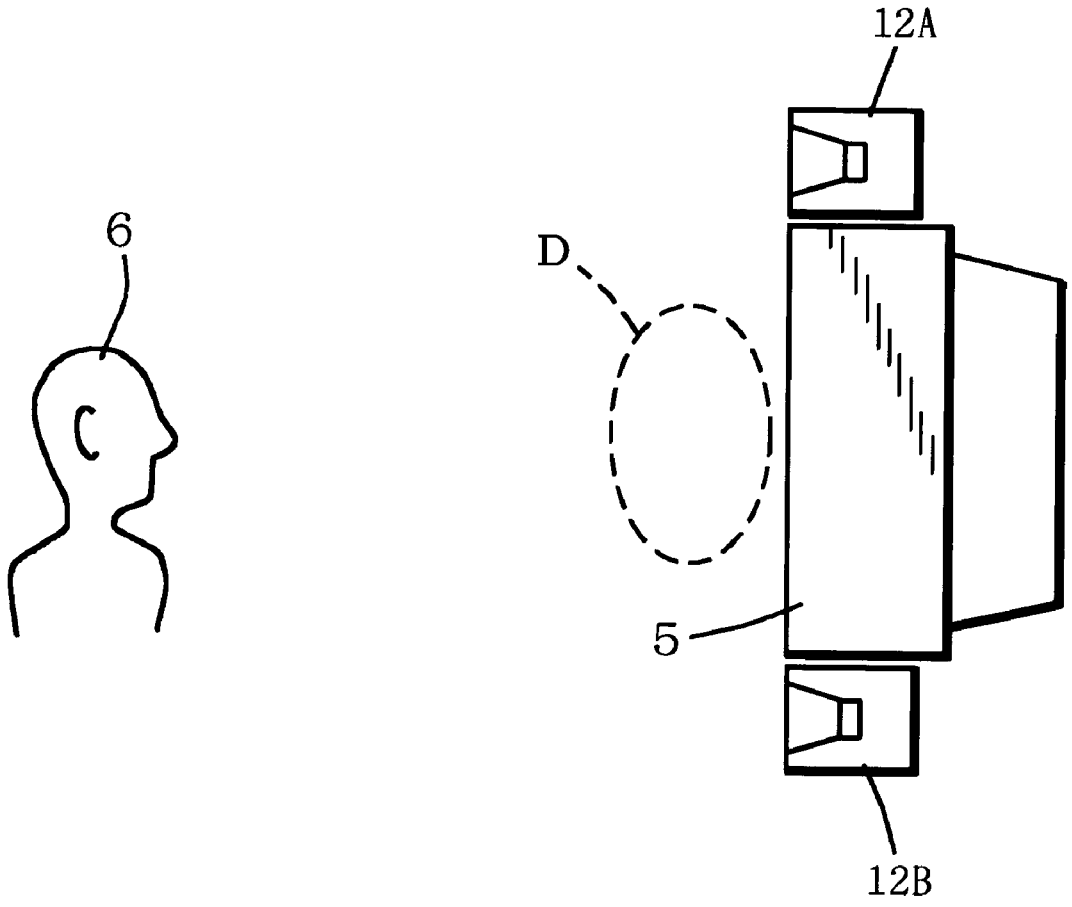
FIG. 19 PRIOR ART
FIG. 19 is a graph in the assistance of explaining the positioning of another conventional loudspeaker and the localizing of sound image in a state where the loudspeaker is used for a center channel of a multichannel sound reproducer.

With reference to FIG. 11, operations performed when the loudspeaker apparatus PS1 constructed as described above is used for reproducing a center channel signal of a multichannel sound reproducer will be described. In FIG. 11, loudspeaker apparatuses 2L and 2R for respectively reproducing left and right channel signals are located on both the left and the right sides of a TV 5 in a manner as same those in FIG. 16. The loudspeaker apparatus PS1 in the first embodiment of the present invention is located on the TV 5 for reproducing a center channel signal. Further, loudspeaker apparatuses 4L and 4R for respectively reproducing surround channel signals are located in the vicinity of walls on the right and left sides of a viewer 6.

The left and right channel signals and the surround channel signals are first reproduced from the loudspeaker apparatuses 2L, 2R, 4L, and 4R as in the conventional example. The center channel signal is radiated as indicated by arrows A from the main speaker unit 1*a*, to reach the viewer 6. Since the level in the vicinity of 6.3 kHz of a sound of the center channel signal is suppressed, the viewer 6 does not easily recognize the position of a sound source in terms of the sense of hearing characteristics. On the other hand, a sound having a frequency in the vicinity of 6.3 kHz reproduced from the sub-speaker unit 1*b* is not directly radiated toward the viewer 6 but is radiated sideward, as indicated by arrows A1, and is reflected from the walls WL and WR or the like, to reach the viewer 6, as indicated by arrows A2. Consequently, the viewer 6 recognizes the sound having a frequency in the vicinity of 6.3 kHz as an indirect sound, so that the position of the sound source is also difficult to recognize. Consequently, a sound image is drawn to a screen due to the effect of visual priority, so that the viewer 6 feels as if the sound image and a picture image coincide with each other. Note that the sound reflected by the walls WL and WR also can be reflected by the walls WF and WB, and then reach the viewer 6 as indirect sound. Then, the viewer feels as if the sound image and picture image coincided with each other, too.

Furthermore, even when the walls WF, WB, WL, and WR are too distant from the speaker apparatus to expect the sound reflection by those walls, the sound diffused by the diffuser SD can reaches the viewer 6 through a roundabout course as the indirect sound. Similarly, the viewer feels as if the sound image and picture image coincide with each other.

Since the dispersing device 1*c* is mounted on the front surface of the sub-speaker 1*b*, its opening 1*ca* should not be directed toward the viewer 6. The main speaker unit 1*a* and the sub-speaker unit 1*b* can be mounted on the same baffle plate 1*db* of the speaker cabinet 1*d*. Consequently, it becomes easy to process the cabinet and assemble the entire loudspeaker apparatus.

Figure 12:
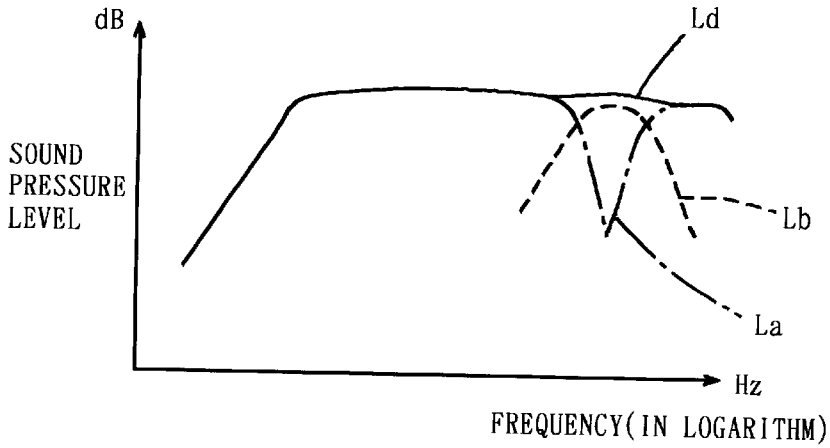
FIG. 12 is a graph for the assistance of explaining the overall response of the sounds reproduced by the loudspeaker apparatus of FIG. 11.

Referring to FIG. 12, frequency characteristics for the viewer 6 of the speaker apparatus PS1 used in the circumstances of FIG. 11 is shown. Similarly in FIG. 5, the solid line La and the dot lines Lb represent the responsibilities of the main-speaker unit 1*a* and the sub-speaker unit 1*b*, respectively. An imaginary line Ld represents the responsibility of overall sound. Thus, when a divisional reproduction of 6.3 kHz by the main-speaker and sub-speaker for the sake of coinciding of sound image and video image is performed, the viewer 6 can enjoy listening to such combined sound without a feeling of wrongness.

(Second Embodiment)

Figure 13:
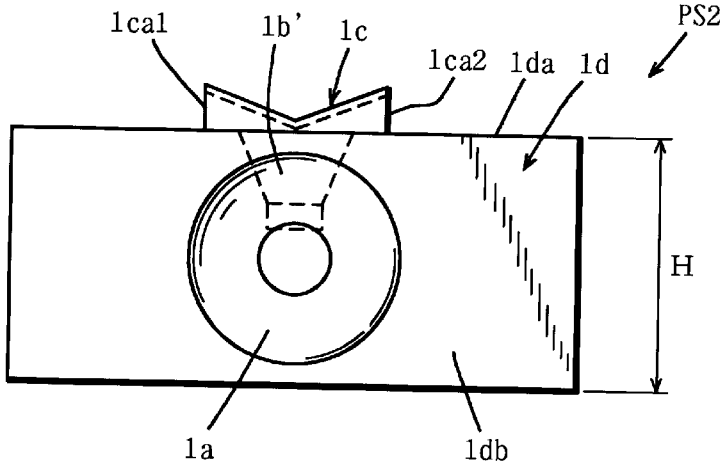
FIG. 13 is a front view showing a loudspeaker apparatus according to a second embodiment of the present invention.
Figure 14:
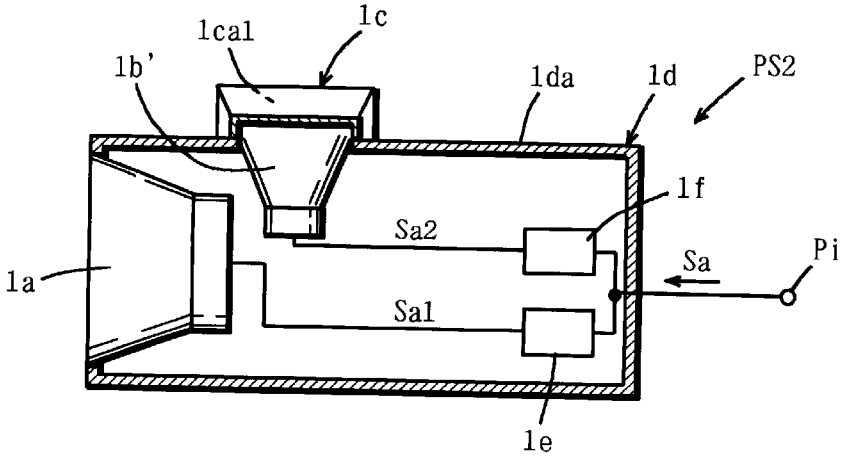
FIG. 14 is a cross-sectional view showing the loudspeaker apparatus of FIG. 13.

Referring to FIGS. 13 and 14, a speaker apparatus according to the second embodiment of the present invention is described. As shown in FIG. 13 showing the front view of the speaker apparatus PS2, a main speaker unit 1*a* is mounted on a front baffle plate 1*db* of a speaker cabinet 1*d*, as in the first embodiment. Further, a sub-speaker unit 1*b*' is mounted on a ceiling surface 1*da* of a speaker cabinet 1*d*. A dispersing device 1*c* is mounted on a front surface of the sub-speaker unit 1*b*' by a mounting device, and its openings 1*ca*1 and 1*ca*2 are so set as to be directed rightward and leftward. A dip circuit 1*e* for suppressing a signal having a frequency in the vicinity of 6.3 kHz and a band-pass circuit 1*f* for passing only the signal in the vicinity of 6.3 kHz are respectively connected to the main speaker unit 1*a* and the sub-speaker unit 1*b*', as in the first embodiment. The main speaker unit 1*a* and the sub-speaker unit 1*b*' are so adjusted as to respectively exhibit sound pressure frequency characteristics indicated in FIG. 12, as in the first embodiment.

Figure 15:
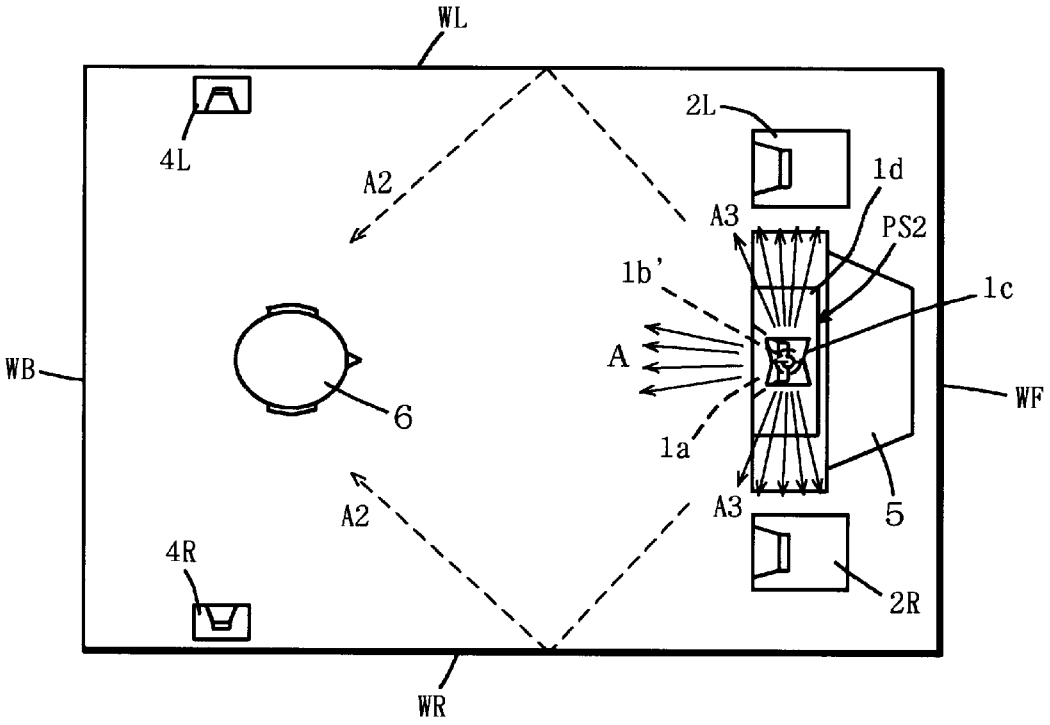
FIG. 15 is a graph in the assistance of explaining an operation of the loudspeaker apparatus, according to the second embodiment of the present invention, in a state where the loudspeaker is used for a center channel of a multichannel sound reproducer.

With reference to FIG. 15, operations performed when the loudspeaker apparatus PS2 according to the second embodiment constructed as described above is used for reproducing a center channel signal of a multichannel sound reproducer will be described. In FIG. 15, loudspeaker apparatus 2L and 2R for left and right channels and loudspeaker apparatus 4L and 4R for surround channels are the same as those in the first embodiment. The loudspeaker apparatus PS2 the second embodiment of the present invention is located on a TV 5 for reproducing a center channel signal.

In a multichannel sound reproducer constructed as described above, the center channel signal is radiated as indicated by arrows A from the main speaker unit 1*a,* to reach a viewer 6. Since the level in the vicinity of 6.3 kHz of a sound of the center channel signal is suppressed, the viewer 6 does not easily recognize the position of a sound source in terms of the sense of hearing characteristics. On the other hand, a sound having a frequency in the vicinity of 6.3 kHz reproduced from the sub-speaker unit 1*b* is not directly radiated toward the viewer 6 but radiated sideward, as indicated by arrows A3, and is reflected from walls WL and WR (WB and WF) or the like, to reach the viewer 6, as indicated by arrows A2. Consequently, the viewer 6 recognizes the sound having a frequency in the vicinity of 6.3 kHz as an indirect sound, so that the position of the sound source is also difficult to recognize. Also in the case that no reflection by the walls WF, WB, WL, and WR can be expected, the diffused sound from the dispersing unit 1*c* can reach the viewer 6 through the roundabout course. Consequently, a sound image is drawn to a screen due to the effect of visual priority, so that the viewer 6 feels as if the sound image and a picture image coincide with each other, as in the first embodiment.

In the present embodiment, the sub-speaker unit 1*b* is mounted on the ceiling surface 1*da* of the speaker cabinet 1*d*. Specifically, the two sound radiation axes Lc and Lc' of speaker units 1*a* and 1*b,* respectively, are perpendicular to each other, or the two planes parallel to those axes Lc and Lc' are perpendicular to each other. Consequently, the degradation of the characteristics of the main speaker unit 1*a* by the dispersing device 1*c* need not be taken as a problem. Further, the height H of the loudspeaker apparatus can be set to a height at which the main speaker unit 1*a* is mounted thereon, so that the height can be significantly decreased, as compared with that in the first embodiment. Consequently, reproduction of a center channel signal in which the picture image and the sound image coincide with each other can be realized without being visually interfered with.

Although in each of the embodiments of the present invention, description was made of a case where the number of main speaker units is one, it goes without saying that it may be of construction using a so-called multi-way system, for example, two-way construction comprising a woofer and a tweeter.

As described in the foregoing, the present invention comprises a main speaker unit for reproducing a signal whose level in a particular band in a high-frequency band is suppressed, a sub-speaker unit for reproducing a signal in only the particular band, and a dispersing device located on a front surface of the sub-speaker unit and so constructed that a reproduced sound radiated from the sub-speaker unit is mainly composed of a diffused sound, so that the recognition of a sound source is obscured, thereby making it possible to realize reproduction in which a sound image and a picture image coincide with each other by simple construction and a simple method of installation of a loudspeaker apparatus which are the same as those of the conventional loudspeaker apparatus due to the effect of visual priority.

Furthermore, the sub-speaker unit having the dispersing device provided on its front surface is mounted on a ceiling surface of a speaker cabinet, so that the height of the loudspeaker apparatus can be decreased, thereby making it possible to significantly improve visual interference while obtaining reproduction of a center channel signal in which a sound image and a picture image coincide with each other.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A loudspeaker apparatus for converting a first audio signal to audible sound comprising:

a bottom;

a front perpendicular to said bottom;

a band suppression circuit operable to suppress a first predetermined frequency band in the first audio signal to produce a second audio signal;

a first speaker unit, connected to said band suppression circuit, operable to convert the second audio signal to a first sound wherein the first predetermined frequency band is suppressed and to emit the first sound from said front;

a band pass filter operable to pass a second predetermined frequency band in the first audio signal to produce a third audio signal;

a second speaker unit, connected to said band pass filter, operable to convert the third audio signal to a second sound wherein the second predetermined band is audible, and to emit the second sound; and a dispersing device oriented to disperse and output sound from said second speaker unit in a direction parallel to both said front and said bottom and to cover said second speaker unit to block sound from said second speaker unit from radiating from said front, and comprising opposing end openings oriented to output sound in a direction parallel to both said front and said bottom, and a sound reflecting member formed in a shape that widens from the center of said dispersing device outward toward said opposing end openings of said dispersing device and positioned to reflect the second sound at least one time in said dispersing device, said sound reflecting member comprising a first top plate and first and second side walls, said first and second side walls extending by a predetermined length longer than half of a sound wave length corresponding to the second predetermined band and diverging from each other at a first predetermined angle.

2. A loudspeaker apparatus as claimed in claim 1 for use with an image reproducer, said loudspeaker apparatus to be located above and in the vicinity of the image reproducer and operable to exclusively reproduce a center channel signal in a multi-channel sound signal for a movie or the like.

3. A loudspeaker apparatus as claimed in claim 1, wherein said band suppressing means is comprised of a dip circuit; and said band filter means is comprised of a band-pass circuit.

4. A loudspeaker apparatus as claimed in claim 1, wherein said first and second speaker units each have a sound radiating axis and said first speaker unit and said second speaker unit are arranged such that the sound radiating axes thereof, respectively, are parallel to each other.

5. A loudspeaker apparatus as claimed in claim 4, wherein said first speaker unit and said second speaker unit are located on one plane.

6. A loudspeaker apparatus as claimed in claim 1, wherein said first and second speaker units each have a sound radiating axis and said first speaker unit and said second speaker unit are arranged such that the sound radiating axes thereof are perpendicular to each other.

7. A loudspeaker apparatus as claimed in claim 6, wherein said first speaker unit is located on a first plane; and said second speaker unit is located on a second plane perpendicular to the first plane.

8. A loudspeaker apparatus as claimed in claim 1, wherein the first and second predetermined bands are the same.

9. A loudspeaker apparatus as claimed in claim 8, wherein the first and second predetermined bands are in a range of approximately a half to two octaves and are not less than 4 kHz.

10. A loudspeaker apparatus as claimed in claimed in claim 8, wherein the first and second predetermined bands are in a predetermined range centered around 6.3 kHz.

11. A loudspeaker apparatus as claimed in claim 1, wherein said second speaker unit has a sound radiating axis, and said dispersing means further comprises a sound diffusing means having a second top wall and third and fourth side walls connected to said first top wall and said first and second side walls, respectively, on the distal end of said diffusing means with respect to the sound radiating axis of said second speaker unit for diffusing the second sound in various directions, said third and fourth side walls being diverging from each other at a second predetermined angle.

* * * * *